US007677545B2

(12) United States Patent
Iwami et al.

(10) Patent No.: US 7,677,545 B2
(45) Date of Patent: Mar. 16, 2010

(54) PAPER-SHEET STORING AND FEEDING DEVICE

(75) Inventors: Toyofumi Iwami, Himeji (JP); Michio Yamamoto, Himeji (JP)

(73) Assignee: Glory Ltd., Himeji-Shi (JP)

( * ) Notice: Subject to any disclaimer, the term of this patent is extended or adjusted under 35 U.S.C. 154(b) by 87 days.

(21) Appl. No.: 11/997,369

(22) PCT Filed: Aug. 5, 2005

(86) PCT No.: PCT/JP2005/014430

§ 371 (c)(1),
(2), (4) Date: Jan. 30, 2008

(87) PCT Pub. No.: WO2007/017923

PCT Pub. Date: Feb. 15, 2007

(65) Prior Publication Data

US 2008/0230981 A1 Sep. 25, 2008

(51) Int. Cl.
*B65H 5/22* (2006.01)

(52) U.S. Cl. ..... 271/3.01; 271/3.12; 271/3.13; 271/153; 271/157; 271/180

(58) Field of Classification Search ..... 271/3.01, 271/3.12, 3.13, 126, 149, 457, 180, 181, 271/153

See application file for complete search history.

(56) References Cited

U.S. PATENT DOCUMENTS 4,235,432 A * 11/1980 Marschke ..... 271/11
4,625,870 A * 12/1986 Nao et al. ..... 209/534
5,104,109 A * 4/1992 Kubo ..... 271/3.12
5,551,834 A 9/1996 Thompson et al.
5,709,525 A 1/1998 Marzullo et al.
5,745,141 A 4/1998 Miyawaki
6,123,330 A * 9/2000 Schaal ..... 271/31
6,533,261 B2 * 3/2003 Katou et al. ..... 271/3.12
6,782,678 B1 8/2004 Bodereau
2002/0096821 A1 7/2002 Sato et al.

FOREIGN PATENT DOCUMENTS

JP 61-023037 A1 1/1986
JP 02-052854 A1 2/1990
JP 05-058016 A1 3/1993
JP 05-262446 A1 10/1993
JP 07-149463 A1 6/1995
JP 2000-072311 A1 3/2000
JP 2002-211824 A1 7/2002

* cited by examiner

*Primary Examiner*—David H Bollinger
(74) *Attorney, Agent, or Firm*—Burr & Brown

(57) ABSTRACT

A sheet storing/feeding device includes a receptacle for holding standing sheets, a stacking and feeding mechanism to successively carry the sheets into the receptacle and to feed a forefront sheet out of the receptacle. A pushing member configured to be optionally advanced and retracted is provided on the side of the forefront sheet in the receptacle, and a holding member is provided to be in contact with a backmost sheet in the receptacle. A retaining member is provided to be optionally advanced and retracted relative to a storage space defined between the stacking and feeding mechanism and the holding member. The retaining member, when advanced, can hold the sheets in the receptacle between the retaining member and the holding member so as to bring them into a temporary holding state, while, when retracted, can release the paper-sheets in the temporary holding state.

3 Claims, 8 Drawing Sheets

PAPER-SHEET STORING AND FEEDING DEVICE

FIELD OF THE INVENTION

The present invention relates to a paper-sheet storing and feeding device adapted to temporarily stack paper-sheets fed from the exterior and then bring them into a stored state as well as being adapted to feed out the paper-sheets in the stored state to the exterior.

BACKGROUND OF THE INVENTION

Traditionally, the paper-sheet storing and feeding device was adapted to bring the paper-sheets (e.g., banknotes or the like) fed successively, one sheet for each operation, from the exterior, into a standing stored state and then feeding out the paper-sheets in the stored state to the exterior has been known.

As the paper-sheet storing and feeding device of this type, one configured to temporarily take the paper-sheets fed from the exterior into a taking-in space and then carry the paper-sheets in the taking-in space into a storage space so as to bring them into a stored state has been known. The taking-in space and the storage space are separated from each other by a partition plate or the like. Upon carrying the paper-sheets in the taking-in space into the storage space, a beating belt, a rigidness enhancing apparatus or a stacking lever is used.

However, in the case of employing such a paper-sheet storing and feeding apparatus, there is a risk that the paper-sheets may be folded or deformed when the paper-sheets in the taking-in space are carried into the storage space. Therefore, it is significantly difficult to carry the paper-sheets in the taking-in space, stably and securely, into the storage space and bring them into the stored state.

More specifically, for instance, JP2000-72311A discloses a paper-sheet storing and feeding device including the taking-in space, in which the paper-sheets fed from the exterior are first taken, and the storage space, in which the paper-sheets in the taking-in space are then carried and brought into a stored state. In this paper-sheet storing and feeding device, a partition plate for separating the paper-sheets stored in the storage space from the paper-sheets reserved in the taking-in space is provided. In addition, a pusher (or pushing plate) is provided, for pushing the paper-sheets reserved in the taking-in space into the storage space.

In such a paper-sheet storing and feeding device, because the taking-in space, in which the paper-sheets fed from the exterior are first taken, and the storage space for storing the paper-sheets therein are separated, there is a need for pushing the paper-sheets in the taking-in space into the storage space by using the pusher. However, the paper-sheets are likely to be curved when they are pushed into the storage space by the pusher, thus leading to folding and/or deformation of the paper-sheets.

SUMMARY OF THE INVENTION

The present invention was made in view of the above problems, and therefore it is an object to provide a paper-sheet storing and feeding device, which can prevent the paper-sheets in a receptacle from being folded and/or deformed upon storing and feeding out the paper-sheets.

It is another object of the present invention to provide a paper-sheet storing and feeding device, which can achieve significant downsizing and reduction of the production cost, by decreasing the number of driving sources.

The present invention is a paper-sheet storing and feeding device adapted to temporarily stack paper-sheets fed from the exterior and then bring them into a stored state as well as being adapted to feed out the paper-sheets in the stored state to the exterior, the paper-sheet storing and feeding device comprising:

a receptacle adapted for placing the paper-sheets thereon in a standing state;

a stacking and feeding mechanism adapted to successively carry the paper-sheets fed from the exterior, into the receptacle, temporarily stacking the paper-sheets, as well as being configured to be in contact with a forefront paper-sheet in the receptacle and then feeding out the forefront paper-sheet, thereby feeding out the paper-sheets in the stored state:

a pushing member provided on the side of the forefront paper-sheet in the receptacle, and configured to be optionally advanced and retracted relative to the forefront paper-sheet, such that when advanced, the pushing member can press the forefront paper-sheet backward so as to disconnect the paper-sheet from the stacking and feeding mechanism, while being retracted, the pushing member can be moved away from the forefront paper-sheet so as to bring the paper-sheet into contact with the stacking and feeding mechanism;

a holding member provided to be in contact with a back-most paper-sheet in the receptacle, and configured to be optionally advanced and retracted relative to the stacking and feeding mechanism;

a storage space defined between the stacking and feeding mechanism and the holding member in the receptacle, and adapted for storing the paper-sheets therein;

a retaining member provided to be optionally advanced and retracted relative to the storage space, such that when advanced, the retaining member can be in contact with the forefront paper-sheet among the paper-sheets moved to be spaced away from the stacking and feeding mechanism due to the pushing member in the receptacle, so as to hold the paper-sheets between the retaining member and the holding member so as to bring them into a temporary holding state while being retracted, the retaining member can release the paper-sheets; and a drive mechanism configured to operate the pushing member, the holding member and the retaining member, such that the holding member can be retracted and moved away from the stacking and feeding mechanism while the pushing member can be advanced, and the retaining member can be advanced into the storage space so as to bring the paper-sheets having been moved to be spaced away from the stacking and feeding mechanism due to the pushing member in the receptacle, into the temporary holding state, thereby defining a temporary stacking space, such that upon bringing the newly stacked paper-sheets in the temporary stacking space due to the stacking and feeding mechanism into the stored state, the holding member can be advanced toward the stacking and feeding mechanism while the retaining member can be retracted from the forefront paper-sheet in the temporary holding state in the receptacle.

According to this paper-sheet storing and feeding device, upon bringing the paper-sheets, newly stacked in the temporary stacking space due to the stacking and feeding mechanism into the stored state, the holding member can be advanced toward the stacking and feeding mechanism so as to press the paper-sheets in the temporary holding state in the receptacle toward the stacking and feeding mechanism, while the retaining member can be retracted from the forefront paper-sheet in the temporary holding state in the receptacle. Therefore, the paper-sheets newly taken into the receptacle from the exterior due to the stacking and feeding mechanism, and the paper-sheets already in the temporary holding state in the receptacle, can be combined together and brought into the stored state without being deformed.

In addition, the storing operation for the paper-sheets and the preparation for feeding out the paper-sheets already in the stored state can be performed simultaneously in a continuous operation.

In the paper-sheet storing and feeding device of this invention, it is preferred that the retaining member includes a pair of upper and lower claws respectively located above and below the storage space, wherein each claw includes a first claw part having a proximal end turnably turned by an axis fixed in position to the receptacle and a distal end, and a second claw part having a proximal end turnably turned at the distal end of the first claw and a distal end, and wherein the drive mechanism operates the retaining member such that when the retaining member is retracted from the storage space, the side face of the second claw part is extended substantially along the surface of the newly stacked paper-sheets in the temporary stacking space located in the receptacle, by turning the second claw part relative to the first claw part and together with turn of the first claw part.

According to this paper-sheet storing and feeding device, when the respective claw is retracted from the storage space for the paper-sheets, the side face of the second claw part provided at the distal end of the claw can be kept in the state of being extended substantially along the surface of the paper-sheet newly stacked in the temporary stacking space in the receptacle. Therefore, phenomena in which the surface of the paper-sheet that is newly stacked in the receptacle would not get caught on distal end of the claw and damage of the paper-sheet caused thereby can be prevented.

In the paper-sheet storing and feeding device of this invention, it is preferred that the drive mechanism operates the retaining member, such that the retaining member can be advanced together with advancing movement of the pushing member as well as being retracted together with advancing movement of the holding member.

According to this paper-sheet storing and feeding device, the advancing and retracting movements of the retaining member can be automatically performed, depending on a state of shifting the paper-sheets in the receptacle. More specifically, when the pushing member is advanced so as to move the paper-sheets away from the stacking and feeding mechanism and bring them into the temporary holding state, the retaining member can be automatically advanced, while the holding member is advanced so as to bring the paper-sheets in the temporary holding state into the stored state and the retaining member can be automatically retracted.

In the paper-sheet storing and feeding device of this invention, it is preferred that the drive mechanism operates the pushing member, the holding member and the retaining member, together with one another.

According to this paper-sheet storing and feeding device, a series of operations of the pushing member, the holding member and the retaining member can be performed by using a single driving source, such as a motor, as such the entire structure of the paper-sheet storing and feeding device can be simplified as well as the production cost being significantly reduced.

In the paper-sheet storing and feeding device of this invention, it is preferred that a detection sensor having a light-emitting part and a light-receiving part is provided in the vicinity of the receptacle, wherein the receptacle includes a plate adapted for placing the paper-sheets thereon, and a light-blocking member having a proximal end turned by the plate, such that the light-blocking member can be turned between a light-blocking position in which light emitted from the light-emitting part of the detection sensor is blocked so as not to reach the light-receiving part of the detection sensor and a light-passing position in which the light can travel up to the light-receiving part, wherein the holding member includes a light-blocking member pushing unit configured to be in contact with the light-blocking member when an amount of the paper-sheets in the receptacle reaches a criterion when the holding member is advanced upon feeding out the paper-sheets, thereby turning the light-blocking member, and wherein the detection sensor is configured to detect change in a state of the light traveling from the light-emitting part to the light-receiving part when the light-blocking member is turned by the light-blocking member pushing unit of the holding member, thereby detecting a timing on which the amount of the paper-sheets in the receptacle reaches the criterion upon feeding out the paper-sheets.

According to this paper-sheet storing and feeding device, a system for detecting the timing on which the amount of paper-sheets in the stored state is reduced to the criterion, upon feeding out the paper-sheets, can be achieved with a simple construction, thereby reducing the production cost of the paper-sheet storing and feeding device.

In the paper-sheet storing and feeding device of this invention, it is preferred that the holding member includes a plurality of light-blocking member pushing units respectively formed corresponding to different criteria, whereby the relative positional relationship between the holding member and the light-blocking member can be optionally changed so as to select either one of the light-blocking member pushing units for turning the light-blocking member.

According to this paper-sheet storing and feeding device, an operator can set, with ease, the criterion of the paper-sheets to be left in the paper-sheet storing and feeding device, as well as readily altering the set criterion.

DETAILED DESCRIPTION OF THE INVENTION

Hereinafter, one embodiment of the present invention will be described with reference to the drawings. FIGS. 1 to 10 are provided for illustrating the embodiment of a paper-sheet storing and feeding device according to the present invention.

A general construction, a specific construction of each part, operation and effect, and a modification, of the embodiment of the paper-sheet storing and feeding device will be described successively.

Figure 1:
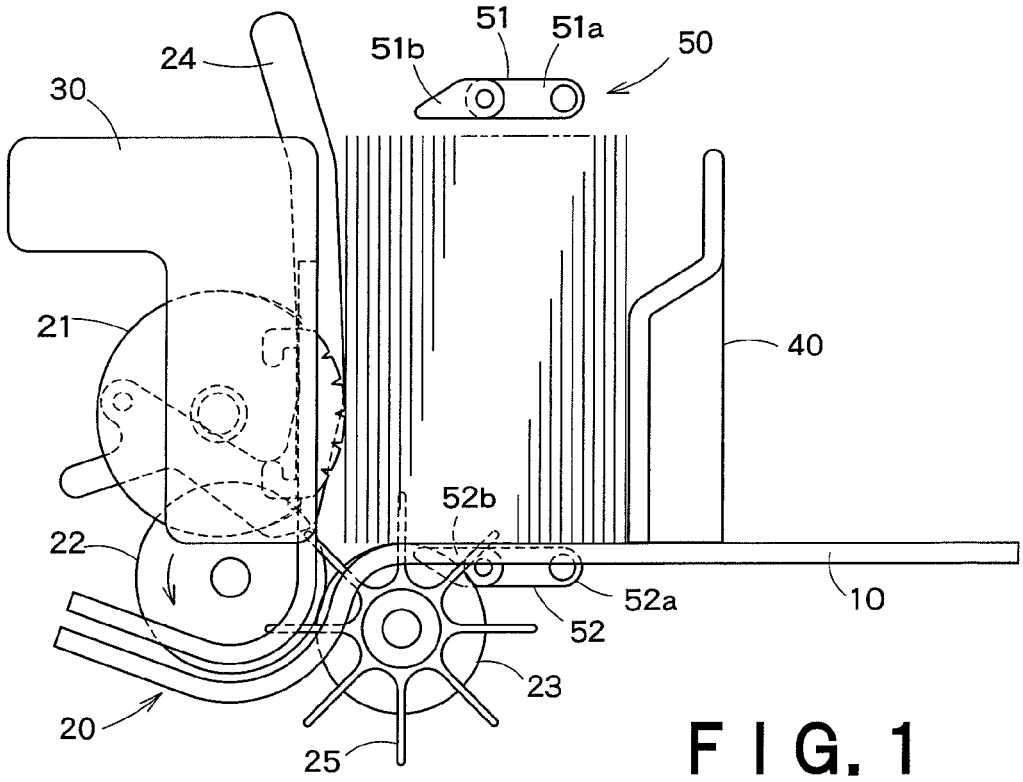
FIG. 1 is a side view showing a schematic construction of a paper-sheet storing and feeding device of the present invention in a state in which paper-sheets can be fed out.

As shown in FIG. 1, the paper-sheet storing and feeding device includes a plate (or receptacle) 10 adapted for placing a plurality of paper-sheets (banknotes or the like) thereon in a standing state, and a stacking and feeding mechanism 20 adapted to successively carry the paper-sheets fed from the exterior, over the plate 10, upon temporarily stacking the paper-sheets, as well as configured to be in contact with a forefront paper-sheet on the plate 10 and then feed out the forefront paper-sheet, upon feeding out the paper-sheets in a stored state.

Furthermore, on the plate 10, a pushing plate (or pushing member) 30 is provided in the vicinity of the stacking and feeding mechanism 20, on the side of the forefront paper-sheet (or on the left side of a group of paper-sheets in FIG. 1) placed on the plate 10. The pushing plate 30 is configured to be optionally advanced and retracted relative to the forefront paper-sheet. In addition, on the plate 10, a holding plate (or holding member) 40 is provided on the side of a backmost paper-sheet (or on the right side of the group of paper-sheets in FIG. 1) placed on the plate 10. The holding plate 40 is configured to be optionally advanced and retracted relative to the stacking and feeding mechanism 20. In front (or on the left side in FIG. 1) of the holding plate 40, a retaining member 50 is provided to be optionally advanced and retracted relative to a storage space 80 defined between the stacking and feeding mechanism 20 and the holding plate 40 on the plate 10. The storage space 80 is used for finally storing the paper-sheets (see FIG. 3).

Figure 9:
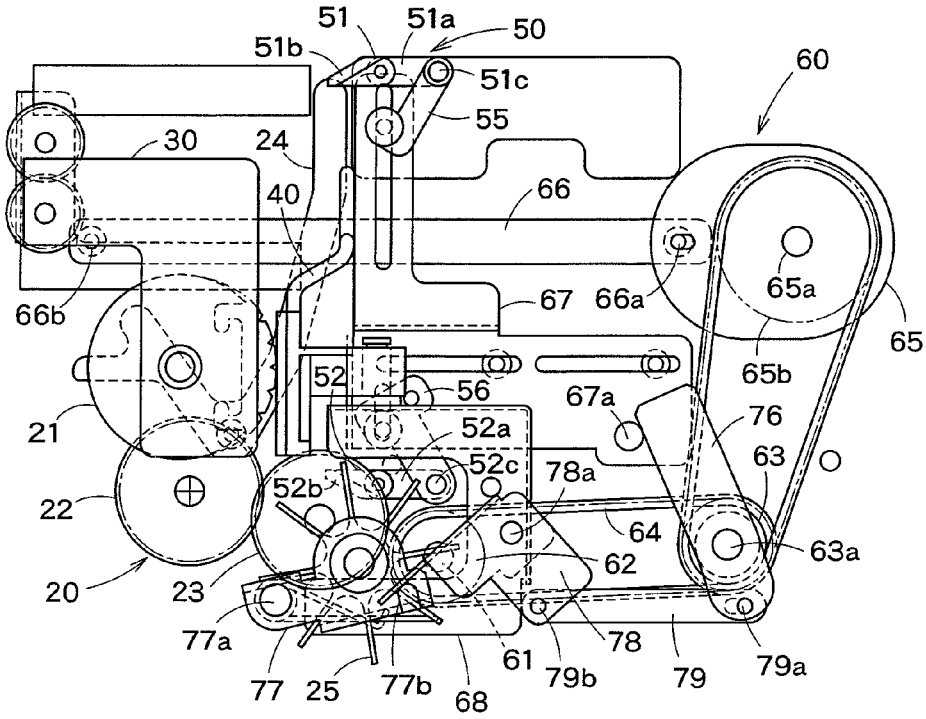
FIG. 9 is a side view showing a detailed construction of a drive mechanism of the paper-sheet storing and feeding device in FIG. 1 upon starting to be ready for temporarily holding the paper-sheets.
Figure 10:
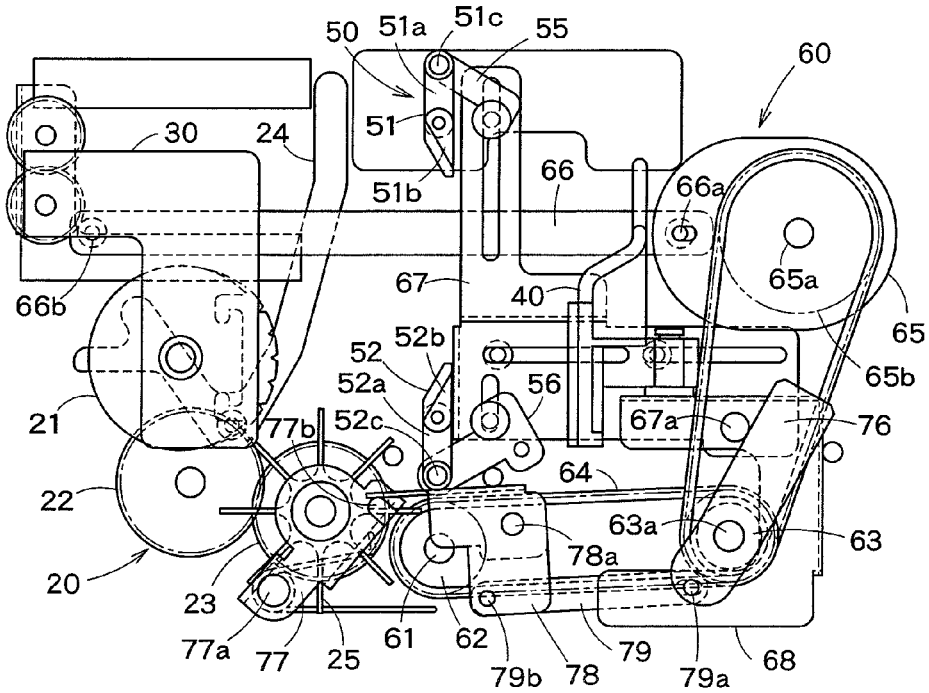
FIG. 10 is a side view showing a detailed construction of the drive mechanism of the paper-sheet storing and feeding device in FIG. 1 upon keeping the temporary holding state of the paper-sheets.

Additionally, as shown in FIGS. 9 and 10, the paper-sheet storing and feeding device includes a drive mechanism 60 for driving the pushing plate 30, holding plate 40 and retaining member 50 while operating them together.

Now, each component of the paper-sheet storing and feeding device will be further detailed.

The stacking and feeding mechanism 20, as shown in FIG. 1, is composed of a kicker roller 21 configured to be continuously turned upon feeding out the paper-sheets, a feed roller 22 provided below the kicker roller 21 and configured to be continuously turned upon feeding in or feeding out the paper-sheets, and a gate roller 23 fixed in position so as to be in contact with the feed roller 22 and configured to form a gate part G between the gate roller 23 and the feed roller 22. In the vicinity of the kicker roller 21, a stacking lever 24 is provided, which is configured to be optionally advanced and retracted relative to the forefront paper-sheet placed on the plate 10. As shown in FIG. 1, a movable rotary rubber vane wheel 25 for beating the paper-sheet is provided on one side of the gate roller 23. The movable rotary rubber vane wheel 25 for beating the paper-sheet is configured to be moved to a position substantially coaxial with the gate roller 23 upon feeding in the paper-sheets (see FIG. 5), while evacuated to a position spaced away from the gate part G upon feeding out the paper-sheets (see FIG. 1).

When feeding out the paper-sheets by using the stacking and feeding mechanism 20, the stacking lever 24 is withdrawn more backward (or leftward in FIG. 1), relative to the group of paper-sheets, as compared with the kicker roller 21, so as to allow the kicker roller 21 to be in contact with the forefront paper-sheet placed on the plate 10 and kick out the forefront paper-sheet below. The paper-sheet kicked out by the kicker roller 21 is then sent to the gate part G, and the feed roller 22 will be in contact with the surface of the paper-sheet so as to feed out the paper-sheets. In this case, the gate part G is configured to separate the paper-sheets fed out by the feed roller 22, one sheet for each operation.

On the other hand, when feeding in the paper-sheets by using the stacking and feeding mechanism 20, the feed roller 22 takes in the paper-sheets fed from the exterior, and the paper sheets taken in by the feed roller 22 are carried over the plate 10 and then temporarily stacked thereon. In this case, each paper-sheet taken in by the feed roller 22 is kicked upward by the movable rotary rubber vane wheel 25 so as to line up the edges of the paper-sheets.

The pushing plate 30, as described above, is provided on the side of the forefront paper-sheet (or on the left side of the group of paper-sheets in FIG. 1) placed on the plate 10, and is configured to be optionally advanced and retracted, in both the left and right directions in FIG. 1, relative to the forefront paper-sheet. The pushing plate 30, when advanced, will press the forefront paper-sheet backward (or rightward in FIG. 1) so as to disconnect the paper-sheet from the kicker roller 21, while being retracted or withdrawn, it will be moved away from the forefront paper-sheet and positioned more backward (or leftward in FIG. 1) as compared with a paper-sheet contacting portion of the kicker roller 21. The pushing plate 30, as shown in FIG. 1, includes a contact face for contacting with the forefront paper-sheet, the contact face being extended upward in the vertical direction relative to the plate 10.

The holding plate 40, as described above, is provided on the side of the backmost paper-sheet (or on the right side of the group of paper-sheets in FIG. 1) on the plate 10, and is configured to be optionally advanced and retracted, in both of the left and right directions in FIG. 1, relative to the kicker roller 21 of the stacking and feeding mechanism 20. The holding plate 40, as shown in FIG. 1, includes a contact face for contacting with the backmost paper-sheet, the contract face being extended upward in the vertical direction relative to the plate 10. The holding plate 40 is configured to press the backmost paper-sheet from behind so as to keep the plurality of paper-sheets arranged on the plate 10 in a standing state.

The retaining member 50 includes a pair of upper and lower claws 51, 52 respectively positioned above and below the storage space 80 for the paper-sheets. In this case, a pair of such retaining members 50 each including a combination of the upper claw 51 and the lower claw 52 are provided so that these members 50 are arranged in the width direction (or in the vertical direction relative to the paper of FIG. 1) of the paper-sheets with a space (i.e., a total of four claws are provided).

Figure 2:
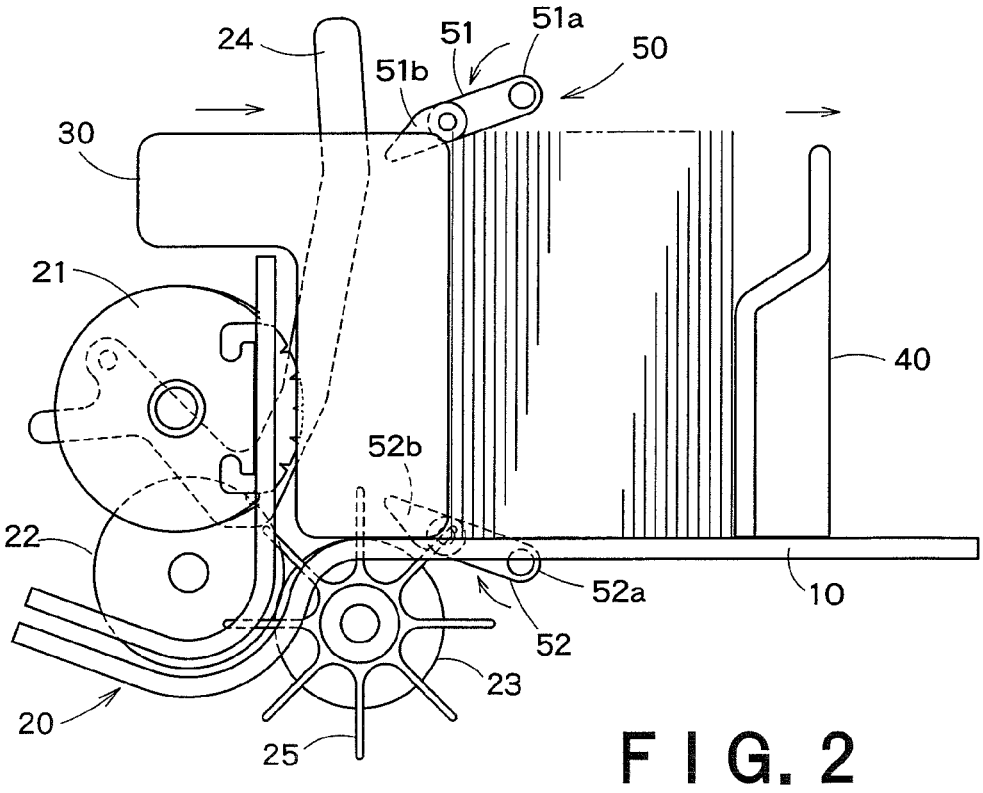
FIG. 2 is a side view showing a schematic construction of the paper-sheet storing and feeding device in FIG. 1 upon starting to be ready for temporarily holding the paper-sheets.
Figure 3:
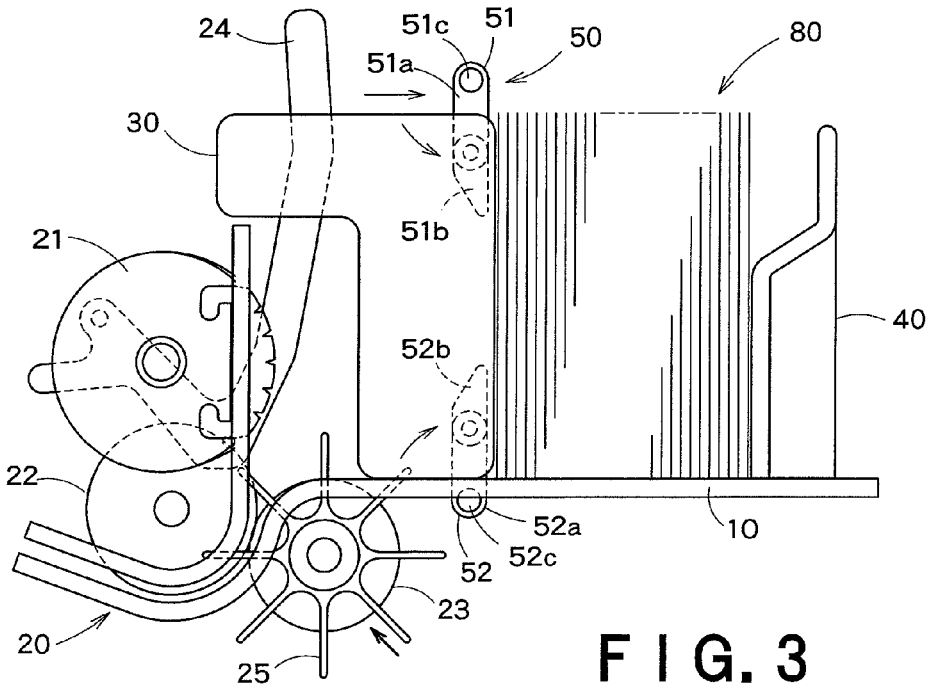
FIG. 3 is a side view showing a schematic construction of the paper-sheet storing and feeding device in FIG. 1 upon being ready for temporarily holding the paper-sheets.

As shown in FIGS. 2 and 3, when each retaining member 50 is advanced, each upper claw 51 will be vertically project downward so as to be in contact with an upper portion of a front face of the forefront paper-sheet, while each lower claw 52 will be vertically project upward so as to be in contact with a lower portion of the front face of the forefront paper-sheet. Consequently, these claws can hold the paper-sheets placed on the plate 10 away from the kicker roller 21, between the claws and the holding plate 40, so as to keep the paper-sheets in a temporary holding state.

Figure 7:
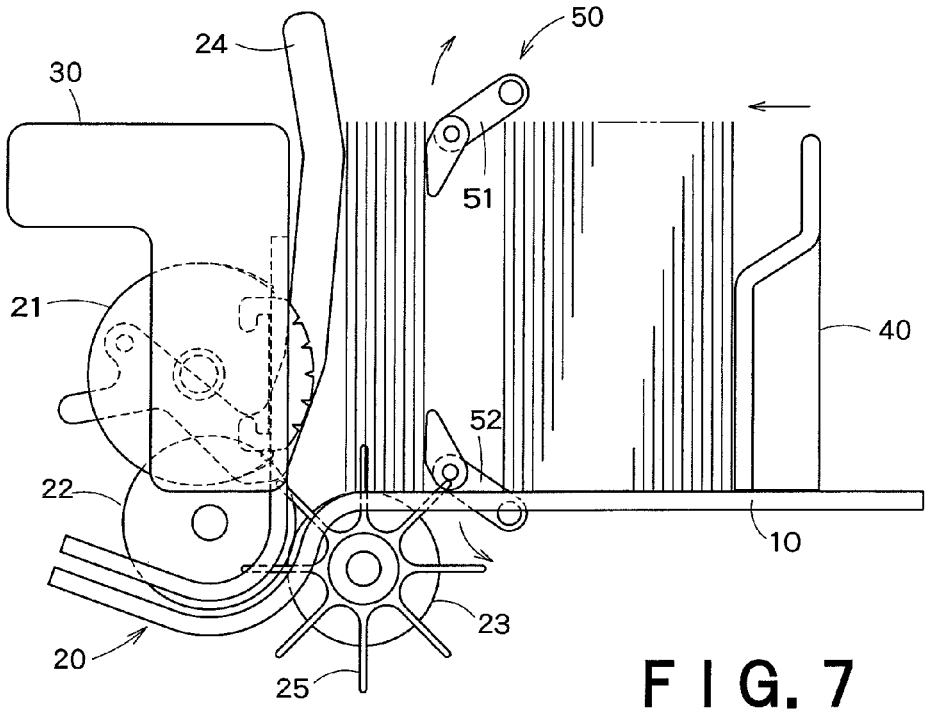
FIG. 7 is a side view showing a schematic construction of the paper-sheet storing and feeding device in FIG. 1 upon starting to store the paper-sheets.
Figure 8:
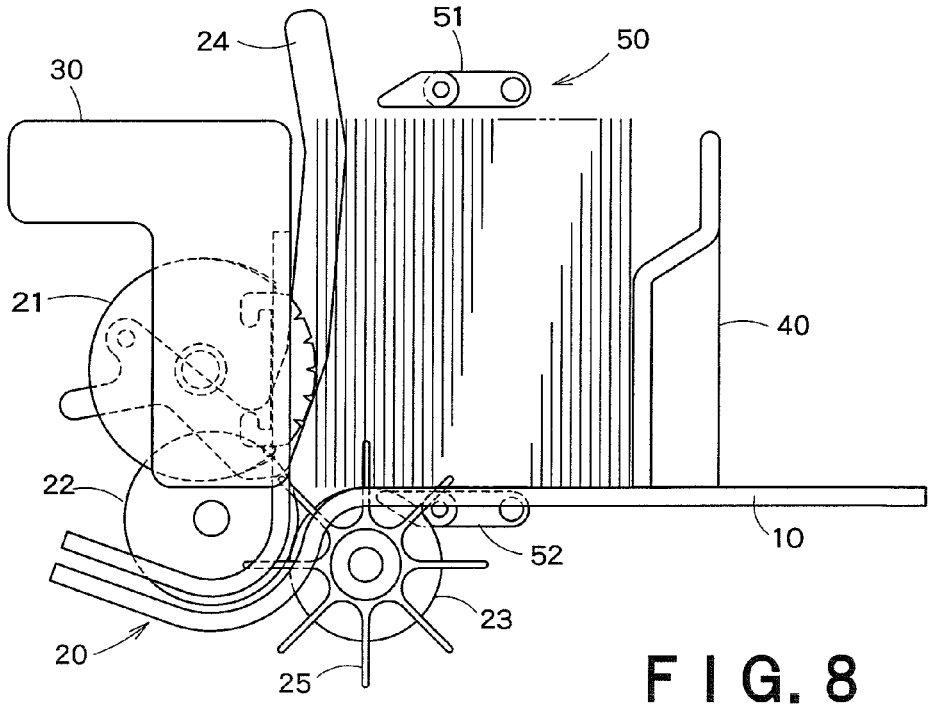
FIG. 8 is a side view showing a schematic construction of the paper-sheet storing and feeding device in FIG. 1 upon completion of storing the paper-sheets.

As shown in FIGS. 7 and 8, when each retaining member 50 is retracted or withdrawn, each upper claw 51 will be retracted upward so as to be moved away from the front face of the forefront paper-sheet being in the temporary holding state, while each lower claw 52 will be retracted downward so as to be moved away from the front face of the forefront paper-sheet. Consequently, each retaining member 50 is moved away from the paper-sheets on the plate 10 so as to release these paper-sheets.

Each upper claw 51 and each lower claw 52 are composed of a proximal first claw part 51*a*, 52*a* and a distal second claw part 51*b*, 52*b*, respectively. Each first claw part 51*a*, 52*a* has a proximal end turnably turned by each axis 51*c*, 52*c* fixed in position relative to the plate 10, and a distal end. Each second claw part 51*b*, 52*b* has a proximal end turnably turned at the distal end of each first claw part 51*a*, 52*a*, and a distal end. In each upper claw 51 as well as in each lower claw 52, torsion coil springs (not shown) are provided to be interposed between each first claw part 51*a*, 52*a* and each second claw part 51*b*, 52*b*, respectively. With such a provision of the torsion coil springs, each first claw part 51*a*, 52*a* and each second claw part 51*b*, 52*b* can take a linear form together, in a normal state, so as to integrally extend (see FIG. 1). Meanwhile, only when some force is externally applied backward to each second claw part 51*b*, 52*b*, each second claw part 51*b* can be turned (in the counter-clockwise direction in the drawing) relative to each first claw part 51*a* while each second claw part 52*b* can be turned (in the clockwise direction in the drawing) relative to each first claw part 52*a*, respectively (see FIG. 7).

When the retaining member 50 is advanced, each first claw part 51*a* and each second claw part 51*b* of the upper claw 51 will take a linear form together so as to integrally extend downward from above the storage space 80 of the paper-sheets, while each first claw part 52*a* and each second claw part 52*b* of the lower claw 52 will take a linear form together so as to integrally extend upward from below the storage space 80 of the paper-sheets. Consequently, the front face of the forefront paper-sheet can be held by these claw parts 51*a*, 51*b*, 52*a*, 52*b*.

To the proximal ends of the first claw parts 51*a*, 52*a*, actuating members 55, 56 (see FIGS. 9 and 10) each adapted to turn each of the first claw parts 51*a*, 52*a* are fixedly attached, respectively, as will be described later.

On the other hand, when the retaining member 50 is retracted, as shown in FIG. 7, each first claw part 51*a* of the upper claw 51 will be turned (in the clockwise direction in the drawing) relative to the axis 51*c* fixed in position, while each second claw part 51*b* will be turned (in the counter-clockwise direction in the drawing) relative to the first claw part 51*a* against a bias force of the torsion coil spring. At the same time, each first claw part 52*a* of the lower claw 52 will be turned (in the counter-clockwise direction in the drawing) relative to the axis 52*c* fixed in position, while each second claw part 52*b* will be turned (in the clockwise direction in the drawing) relative to the first claw part 52*a* against the bias force of the torsion coil spring. In this manner, the retaining member 50 can keep a state in which the respective side faces of the second claw parts 51*b*, 52*b* are extended substantially along the surface of the paper-sheet newly stacked in the temporary stacking space 81 on the plate 10 (described later).

Next, details of the construction of the drive mechanism 60 will be discussed with reference to FIGS. 9 and 10. FIG. 9 is a side view showing a detailed construction of the drive mechanism 60 upon starting to be ready for temporarily holding the paper-sheets, and FIG. 10 is a side view showing a detailed construction of the drive mechanism 60 upon keeping the temporary holding state of the paper-sheets.

The drive mechanism 60, as shown in FIGS. 9 and 10, includes a motor (not shown) used as a driving source, an axis 61 attached to the motor, a first roller 62 configured to be turned about the axis 61, a second roller 63 provided behind (or on the right side in FIG. 9) relative to the first roller 62 and configured to be turned about an axis 63*a*, and a first annular belt 64 provided over the first roller 62 and second roller 63. To the axis 63*a* of the second roller 63, a pressing member 76 is attached.

A generally elliptic linking member 65 is provided above the second roller 63. The linking member 65 includes an axis 65*a* fixed in position to the plate 10, such that it can be turned about the axis 65*a*. The axis 65*a* is located in a position slightly off the center of the generally elliptic linking member 65. In addition, a linking member roller 65*b* is attached to a side face of the linking member 65. Over the linking member roller 65*b* and the second roller 63, a second annular belt 69 is provided. Namely, with a turn of the axis 61 due to actuation of the motor, the linking member 65 is also turned about the axis 65*a*, together with the axis 61.

In the vicinity of an end portion of the side face of the linking member 65, one end 66*a* of a rod-like member 66 is turned, and the other end 66*b* of the rod-like member 66 is in turn pivoted by the pushing plate 30. Thus, with turn of the linking member 65 about the axis 65*a*, the pushing plate 30 is reciprocated in the left and right directions in FIG. 9 on the plate 10.

To a rear face of the holding plate 40 (or a face on the right side in FIG. 9), a linking member 68 is attached, the linking member 68 being also attached to the first annular belt 64. As such, the linking member 68 can be optionally moved in the left and right directions in FIG. 9, in response to the turn of the axis 61.

As described above, each end of the actuating members 55, 56 is fixed to each proximal end of the first claw parts 51*a*, 52*a* of the upper claws 51 and lower claws 52, and these actuating members 55, 56 are configured to turn about the proximal axes 51*c*, 52*c* of the first claw parts 51*a*, 52*a*, respectively. In addition, a bracket 67 is provided above the first roller 62, such that it can be moved relative to the kicker roller 21 (or in the left and right directions in FIG. 9). The other ends of the actuating members 55, 56 are attached to the bracket 67 so as to be movable only in the vertical direction (or upward and downward in FIG. 9).

The bracket 67 is configured to be moved rightward in FIG. 9 together with advancing movement of the pushing plate 30 toward the forefront paper-sheet on the plate 10, while configured to be moved leftward in FIG. 9 together with advancing movement of the holding plate 40 toward the kicker roller 21 of the stacking and feeding mechanism 20. Namely, in a state shown in FIG. 9, when the pushing plate 30 is moved to be spaced away from the kicker roller 21, the bracket 67 is also moved to be spaced away from the kicker roller 21 (or moved rightward in FIG. 9). With such movements, the actuating members 55 are turned about the proximal axes 51*c* of the first claw parts 51*a* (in the counter-clockwise direction in the drawing), respectively, while the actuating members 56 are turned about the proximal axes 52*c* of the first claw parts 52*a* (in the clockwise direction in the drawing), respectively. Consequently, the upper claws 51 and lower claws 52 fixed to the actuating members 55, 56 are also turned about the proximal axes 51*c*, 52*c* of the first claw parts 51*a*, 52*a*, respectively. Thus, the upper claws 51 and lower claws 52 will be advanced downward and upward toward the storage space 80, respectively.

In a state shown in FIG. 10, when the holding plate 40 is moved toward the kicker roller 21, the pressing member 76 is turned due to the turn of the axis 63*a*, as such a pin 67*a* attached to the bracket 67 is pressed leftward in FIG. 10 by the pressing member 76. Thus, the bracket 67 is also moved toward the kicker roller 21 (or moved leftward in FIG. 10). With such movements, the actuating members 55 are turned about the proximal axes 51*c* of the first claw parts 51*a* (in the clockwise direction in the drawing), respectively, while the actuating members 56 are turned about the proximal axes 52*c* of the first claw parts 52*a* (in the counter-clockwise direction in the drawing), respectively. Consequently, the upper claws 51 and lower claws 52 will also be moved to be retracted or withdrawn from the storage space 80, respectively.

In this way, advancing and retracting movements of the retaining member 50 relative to the storage space 80 can be automatically performed, depending on a state of shifting the paper-sheets on the plate 10. Namely, when the paper-sheets are spaced away from the stacking and feeding mechanism 20 so as to stack them by advancing the pushing plate 30, the retaining member 50 can be automatically advanced, while the paper-sheets are moved to reach a feeding-out position on the plate 10 by advancing the holding plate 40 and the retaining member 50 can be automatically retracted.

The rotary rubber vane wheel 25 for beating the paper-sheet is attached to a vane wheel supporting member 77. The vane wheel supporting member 77 can be turned about an axis 77*a*. Specifically, in response to the turn of the axis 61 of the motor, a bracket 78 is turned about an axis 78*a* via a linking member 79. The linking member 79 is connected at a bottom end of the pressing member 76 and has turnable axes 79*a*, 79*b* provided at its both ends. Namely, the bracket 78 is configured to be turned when a projection provided to the bracket 78 is pushed or pressed by a pin 77*b* of the vane wheel supporting member 77.

Thus, as shown in FIGS. 9 and 10, when the axis 61 is turned by the motor, the rotary rubber vane wheel 25 for beating the paper-sheet can be moved from a position located away from the gate part G (not shown) to a position substantially coaxial with the gate roller 23 (FIG. 10).

In such a manner, in the drive mechanism 60, the pushing plate 30, holding plate 40 and retaining member 50 can be moved together, by turning the axis 61 due to the actuation of the motor. In this case, since a series of operations of the pushing plate 30, holding plate 40 and retaining member 50 can be performed by using a single driving source, such as the motor, the entire structure of the paper-sheet storing and feeding device can be simplified as well as cost-cutting achieved.

Next, operation of this embodiment constructed as described above will be discussed.

Figure 4:
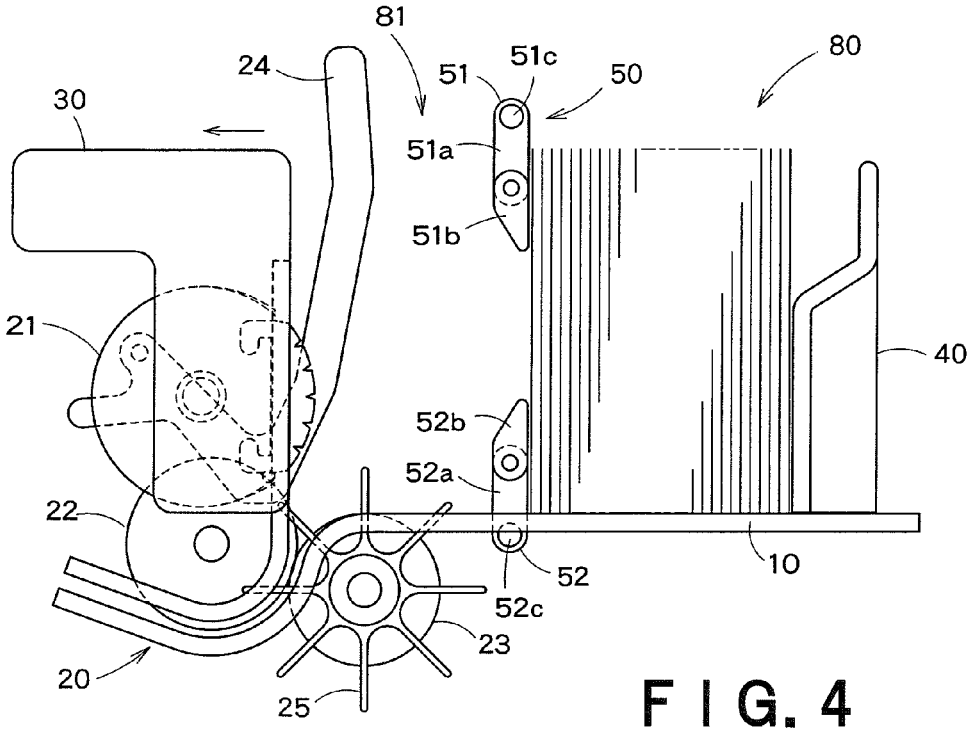
FIG. 4 is a side view showing a schematic construction of the paper-sheet storing and feeding device in FIG. 1 upon keeping a temporary holding state of the paper-sheets.

First, the operation for bringing the paper-sheets placed on the plate 10 into a temporary holding state will be described with reference to FIGS. 2 to 4.

Initially, the holding plate 40, which keeps the paper-sheets in a standing state on the plate 10, is moved rightward in FIG. 2 so as to be spaced away from the kicker roller 21. At the same time, the pushing plate 30 is also moved rightward in FIG. 2 so as to be spaced away from the kicker roller 21, together with the holding plate 40. Consequently, the paper-sheets on the plate 10 are moved rightward in FIG. 2, integrally with the pushing plate 30 and holding plate 40, so as to be spaced away from the kicker roller 21, while being interposed between the pushing plate 30 and the holding plate 40.

Upon operation for starting to temporarily hold the paper-sheets on the plate 10, the retaining member 50 taking a retracted position as shown in FIG. 2 will also be moved together with the advancing movement of the pushing member 30, so as to start to be advanced into the storage space 80.

As a result, the upper claws 51 of the retaining member 50 are projected downward so as to be in contact with an upper portion of the front face of the forefront paper-sheet, respectively, while the lower claws 52 are projected upward so as to be in contact with a lower portion of the front face of the forefront paper-sheet, respectively. Consequently, the paper-sheets on the plate 10 can be held between the retaining member 50 and the holding plate 40 (see FIG. 3). In this state, as shown in FIG. 4, the pushing plate 30 is withdrawn to be spaced away from the holding plate 40. In this manner, the paper-sheet storing and feeding device can define the temporary stacking space 81 between the stacking and feeding mechanism 20 and the retaining member 50 so as to bring the paper-sheets into the temporary holding state therein.

Figure 5:
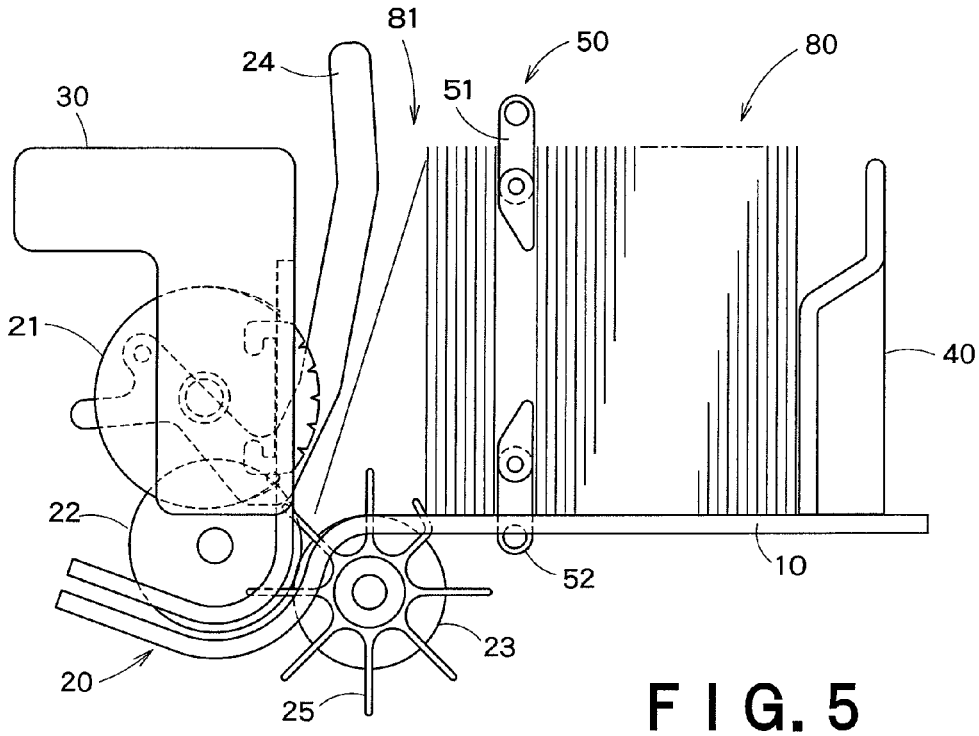
FIG. 5 is a side view showing a schematic construction of the paper-sheet storing and feeding device in FIG. 1 upon temporarily stacking new paper-sheets.
Figure 6:
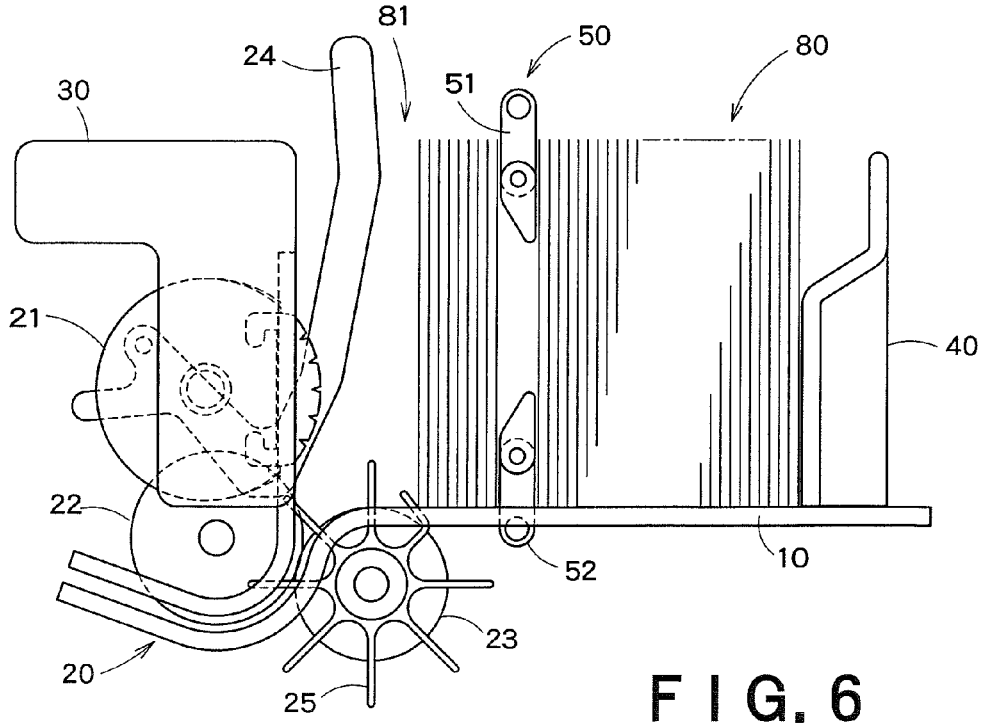
FIG. 6 is a side view showing a schematic construction of the paper-sheet storing and feeding device in FIG. 1 just after temporarily stacking the new paper-sheets.

Next, the operation for stacking the paper-sheets, which are newly fed in succession from the exterior due to the stacking and feeding mechanism 20, into the temporary stacking space 81, will be detailed with reference to FIGS. 5 and 6.

In this step, the paper-sheets are successively fed from the exterior into the gate part G between the feed roller 22 and the gate roller 23. In this case, the feed roller 22 is turned continuously in the counter-clockwise direction in FIG. 5.

The paper-sheets fed from the exterior are taken in the device due to the feed roller 22, and a rear end of each paper-sheet taken in the device is then kicked upward by the movable rotary rubber vane wheel 25 for beating the paper-sheet, such that the paper-sheets are fed on the plate 10. Thereafter, the paper-sheets fed on the plate 10 and stacked in the temporary stacking space 81 are brought into a standing state between the stacking lever 24 and the retaining member 50.

Finally, a step of combining the paper-sheets in the temporary holding state and the paper-sheets temporarily stacked in the temporary stacking space 81 on the plate 10, thereby bringing the combined paper-sheets into a stored state in the storage space 80 will be discussed with reference to FIGS. 7 and 8. In this case, the pushing plate 30 is still kept in the retracted or withdrawn state.

In this step, the upper claws 51 of the retaining member 50 are retracted upward so as to be spaced away from the front face of the forefront paper-sheet kept in the temporary holding state, respectively, while the lower claws 52 are withdrawn downward so as to be spaced away from the front face of the forefront paper-sheet, respectively. Consequently, the retaining member 50 is moved away from the paper-sheets kept in the temporary holding state on the plate 10, as such releasing the paper-sheets from the temporary holding state (see FIGS. 7 and 8). At this time, as shown in FIG. 7, with the turn of the second claw parts 51*b*, 52*b*, caused relative to the first claw parts 51*a*, 52*a* and together with the turn of the first claw parts 51*a*, 52*a*, the second claw parts 51*b*, 52*b* can keep a state in which their side faces are extended substantially along the surface of the paper-sheet placed in the temporary stacking space 81 on the plate 10. Therefore, phenomena in which the surface of the backmost paper-sheet placed in the temporary stacking space 81 would get caught on distal ends of the upper claws 51 and/or lower claws 52 and damage of the paper-sheet is thereby prevented.

In this way, as shown in FIGS. 7 and 8, the holding plate 40 is advanced toward the kicker roller 21 so as to press the paper-sheets on the plate 10 against the kicker roller 21.

Thereafter, the stacking lever 24 is retracted to a position behind the kicker roller 21. With such operations, the storing operation for the paper-sheets and preparations for feeding out the paper sheets in the stored state can be completed (see FIG. 1). Namely, the forefront paper-sheet on the plate 10 in the stored state can take a position to be in contact with the kicker roller 21.

When feeding out the paper-sheets to the exterior in this state, the kicker roller 21 kicks down the forefront paper-sheet which is in contact with the kicker roller 21. Then, the kicked paper-sheet is fed to the gate part G. Subsequently, the feed roller 22 is in contact with the surface of the paper-sheet fed in the gate part G so as to feed out the paper-sheet. At this time, the gate part G separates the paper sheets fed out from the feed roller 22, one sheet for each operation.

As described above, according to the paper-sheet storing and feeding device of this embodiment, the pushing plate (or pushing member) 30 configured to be optionally advanced and retracted is provided on the side of the forefront paper-sheet on the plate (or receptacle) 10, while the holding plate (or holding member) 40 is provided to be in contact with the backmost paper-sheet on the plate (or receptacle) 10. In addition, the retaining member 50 is provided to be optionally advanced and retracted relative to the storage space 80 defined between the stacking and feeding mechanism 20 and the holding plate 40, as such when advanced, the retaining member 50 can hold the paper-sheets on the plate 10 between the retaining member 50 and the holding plate 40 to bring them into the temporary holding state.

Thereafter, when the paper-sheets stacked in the temporary stacking space 81 are first brought into the stored state due to the stacking and feeding mechanism 20, the holding plate 40 will be advanced toward the stacking and feeding mechanism 20 and press the paper-sheets in the temporary holding state on the plate 10 toward the stacking and feeding mechanism 20, while the retaining member 50 will be retracted or withdrawn from the forefront paper-sheet in the temporary holding state on the plate 10. Therefore, the paper-sheets newly fed from the exterior and stacked on the plate 10 due to the stacking and feeding mechanism 20, and the paper-sheets already in the temporary holding state on the plate 10, can be combined together and brought into the stored state, without being deformed, respectively.

Furthermore, the storing operation for the paper-sheets and the preparation for feeding out the paper-sheets in the stored state can be performed simultaneously in a continuous operation.

The paper-sheet storing and feeding device according to the present invention is not limited to the aspect described above, but various modifications can be added thereto.

Figure 11:
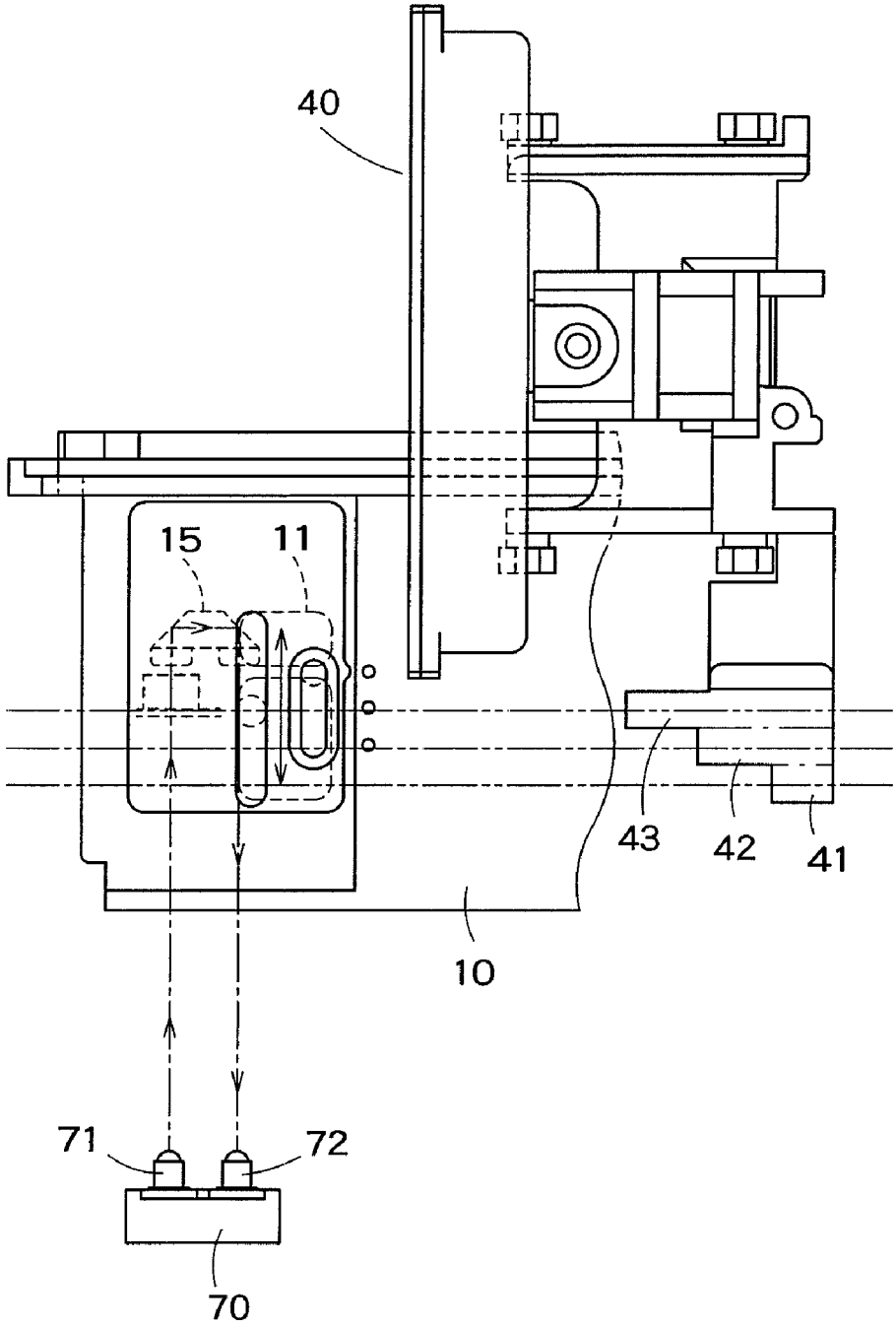
FIG. 11 is a top view showing a construction of the paper-sheet storing and feeding device including a storage amount detection unit for the paper-sheets related to one modification.
Figure 12:
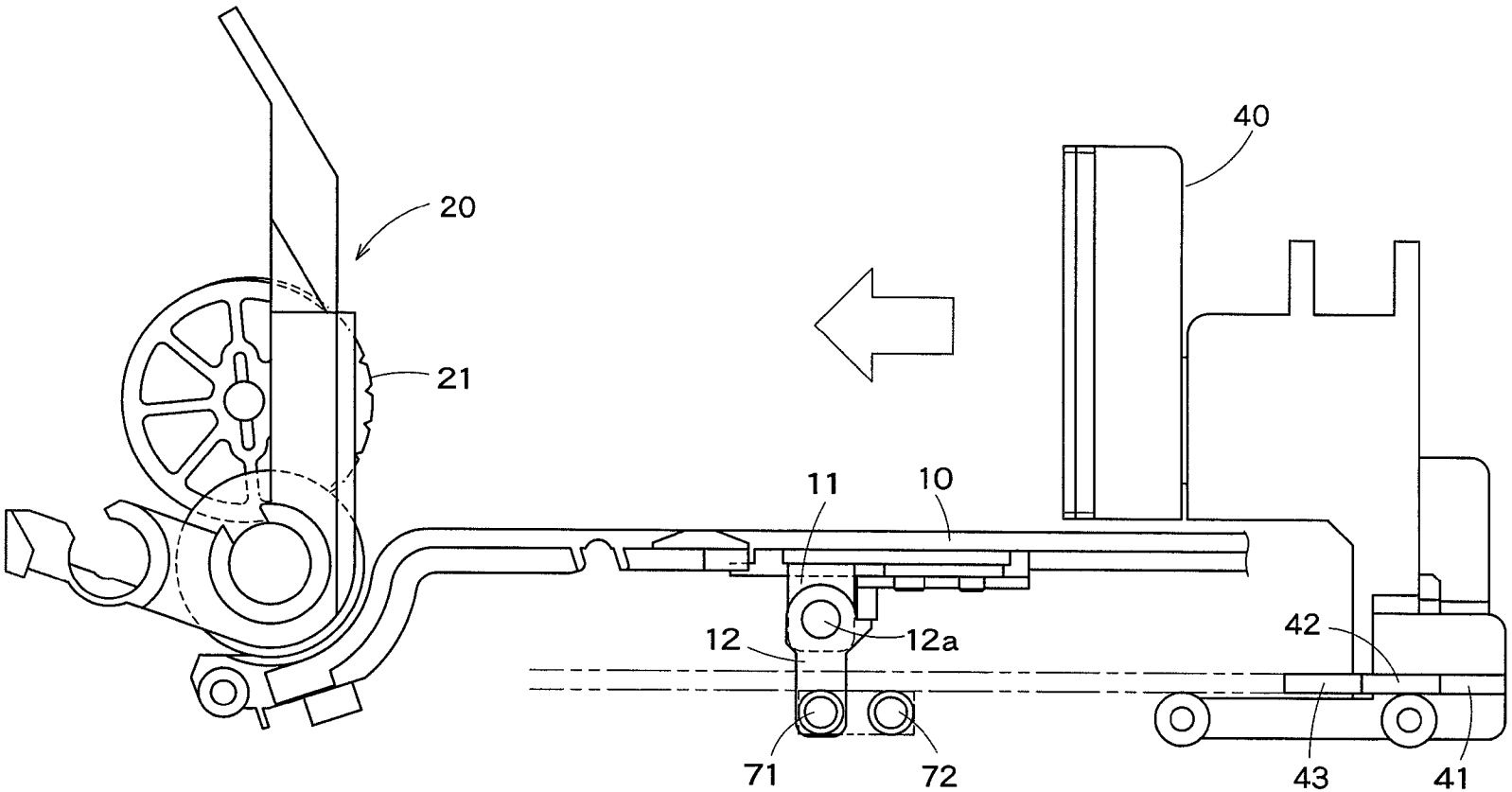
FIG. 12 is a side view of the paper-sheet storing and feeding device in FIG. 11.
Figure 13:
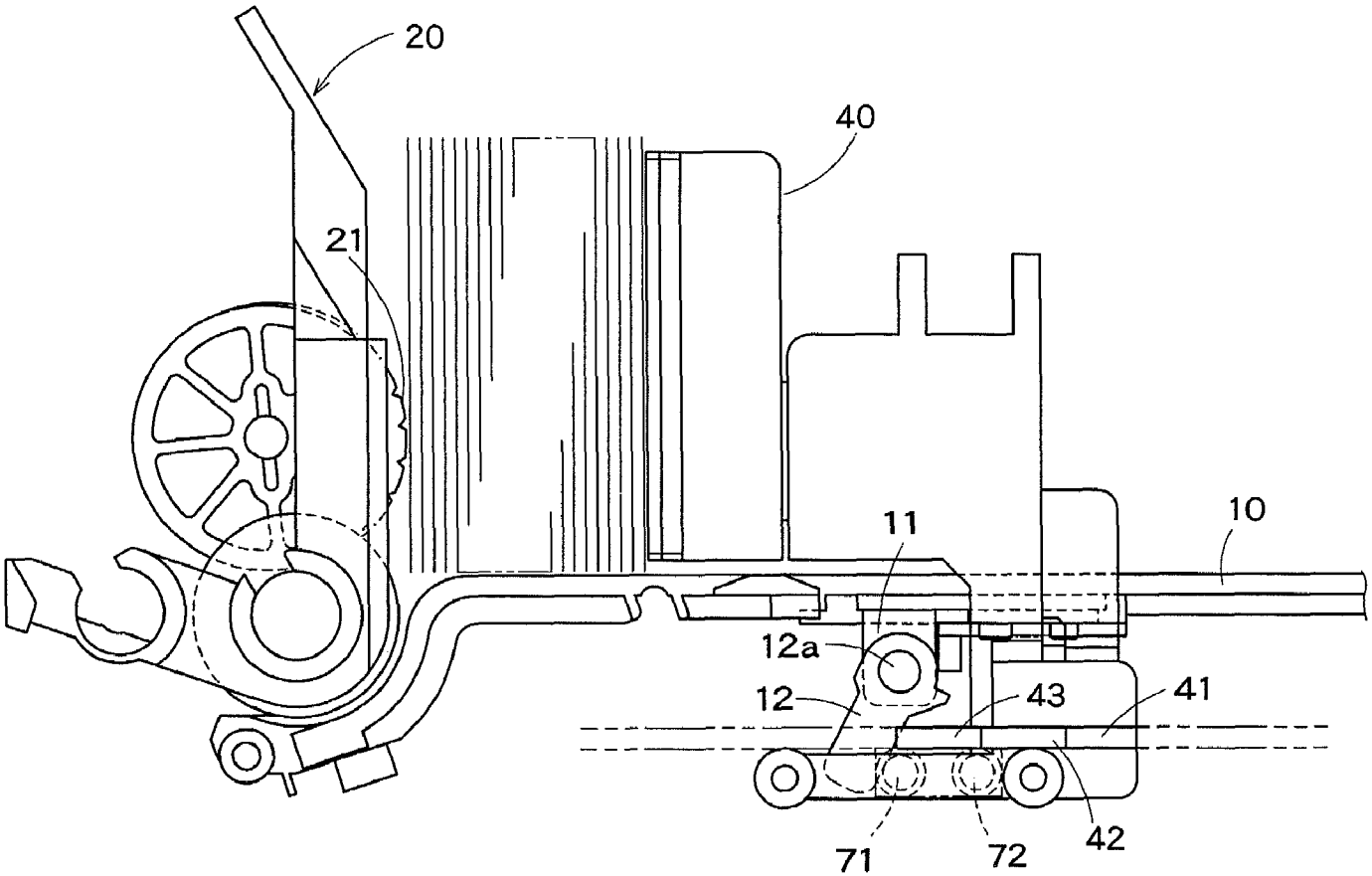
FIG. 13 is a side view of the paper-sheet storing and feeding device in FIG. 11 upon feeding out the paper-sheets.

Next, one modification of the paper-sheet storing and feeding device according to the present invention will be described with reference to FIGS. 11 to 13. In FIGS. 11 to 13, like parts in the embodiment shown in FIGS. 1 to 10 will be designated by like reference numerals and will not be detailed below.

FIG. 11 is a top view showing a construction of the paper-sheet storing and feeding device including a storage amount detection unit for the paper-sheets related to the modification, FIG. 12 is a side view of the paper-sheet storing and feeding device in FIG. 11, and FIG. 13 is a side view of the paper-sheet storing and feeding device upon feeding out the paper-sheets.

The paper-sheet storing and feeding device of this modification is configured to detect a timing on which an amount of the paper-sheets stored therein (hereinafter, also referred to as "an amount of the stored paper-sheets") is reduced to a criterion where the paper-sheets in the stored state are subjected to the feeding out operation.

As shown in FIGS. 11 and 12, a detection sensor (or proximity sensor) 70 is provided in the vicinity of the plate 10, outside the holding plate 40 along the width direction thereof. The detection sensor 70 includes a light-emitting part 71 and a light-receiving part 72. The detection sensor 70 is designed to perform a detection operation by receiving light emitted from the light-emitting part 71, by using the light-receiving part 72.

As shown in FIGS. 11 and 12, a light-blocking member supporting unit 11 extending downward is provided at a bottom face of the plate 10. In addition, at a bottom end of the light-blocking member supporting unit 11, a light-blocking member 12 is turnably moved. The light-blocking member 12 is extended from and just below the light-blocking member supporting unit 11 due to a bias force of a torsion coil spring (not shown).

More specifically, the light-blocking member supporting unit 11 is attached to the plate 10 such that it can be reciprocated in the width direction (or upward and downward in FIG. 11) of the holding plate 40. Thus, the light-blocking member 12 can also be reciprocated in the width direction of the holding plate 40. A proximal end of the light-blocking member 12 is turned by the light-blocking member supporting unit 11 via an axis 12*a* depicted to extend vertically to the paper of FIG. 12. Therefore, the light-blocking member 12 is designed to be optionally turned about the axis 12*a* in a plane vertical to the axis 12*a*.

In the case in which no force is externally applied to the light-blocking member 12, it will be extended from and just below the axis 12*a* due to the bias force of the torsion coil spring (not shown). Such a position of the light-blocking member 12 at this time will be referred to as "a light-blocking position." The light-blocking position will be detailed later.

As shown in FIG. 11, a reflector 15 is attached at the bottom face of the plate 10, the reflector 15 being adapted to reflect the light emitted from the light-emitting part 71 of the detection sensor 70 such that the reflected light can reach the light-receiving part 72.

When no force is externally applied to the light-blocking member 12, a route of the light traveling from the light-emitting part 71 of the detection sensor 70 to the reflector 15 or route of the light traveling from the reflector 15 to the light-receiving part 72 of the detection sensor 70 will be blocked by the light-blocking member 12 located in the light-blocking position.

To the holding plate 40, as shown in FIGS. 11 and 12, a plurality of (e.g., three) light-blocking member pushing units 41, 42, 43 are integrally attached. Each light-blocking member pushing unit 41, 42, 43 is configured to be in contact with the light-blocking member 12 when the holding plate 40 is advanced, so as to make the light-blocking member 12 turn. The light-blocking member pushing units 41, 42, 43 are integrally provided below the plate 10 and designed to be moved in the left and right directions in FIGS. 11 and 12, together with the advancing and retracting movements of the holding plate 40, respectively.

Each light-blocking member pushing unit 41, 42, 43 is configured to have a distal end located in a different position relative to one another in the advancing direction of the holding plate 40 (or along the left direction in FIG. 11). Specifically, among the distal ends of these light-blocking member pushing units 41, 42, 43, the distal end of the light-blocking member pushing unit 43 is located at the front, and the distal end of the light-blocking member pushing unit 41 is located in the rearmost position.

The width of each light-blocking member pushing unit 41, 42, 43 is greater than the width of the light-blocking member 12 and is arranged, such that only one of the light-blocking member pushing units 41, 42, 43 will be in contact with the light-blocking member 12 as the holding plate 40 is advanced forward (or leftward in FIG. 11), so as to move the light-blocking member 12.

For instance, the light-blocking member pushing unit 41 is used for setting the criterion to an amount corresponding to one hundred sheets of banknotes in circulation (or paper-sheets), the light-blocking member pushing unit 42 is used for setting the criterion to an amount corresponding to two hundred sheets of banknotes, and the light-blocking member pushing unit 43 is used for setting the criterion to an amount corresponding to three hundred sheets of banknotes.

Next, operation of this modification constructed as described above will be discussed.

The timing on which the amount of the stored paper-sheets is detected is in a period of time during which the stored paper-sheets are in a state in which they can be fed out or in a period of time for feeding out the paper-sheets. Namely, the amount of the stored paper-sheets can be detected in a period of time during which the holding plate 40 is moved in the direction designated by an arrow depicted in FIG. 12 toward the kicker roller 21 or after completion of this movement.

Because the paper-sheets are interposed between the holding plate 40 and the kicker roller 21, the position of the holding plate 40 is determined based on the amount of the stored paper-sheets on the plate 10. Namely, as the amount of the paper-sheets on the plate 10 is decreased, the holding plate 40 is moved toward the kicker roller 21 (or leftward in FIGS. 11 and 12).

In this modification, an operator can set, in advance, the criterion of the paper-sheets to be left in the paper-sheet storing and feeding device, depending on the arrangement of each light-blocking member pushing unit 41, 42, 43. More specifically, for example, if the operator wants to leave the paper-sheets of the amount corresponding to three hundred sheets in the paper-sheet storing and feeding device, the operator shifts, in advance, the light-blocking member supporting unit 11 to a desired position along the width direction of the plate 10 such that the light-blocking member pushing unit 43 corresponding to the setting, i.e., the criterion=300, will push the light-blocking member 12.

As the stacking and feeding mechanism 20 successively feeds out the paper-sheets to the exterior, the amount of the stored paper-sheets on the plate 10 will be decreased, and the holding plate 40 is moved to approach the kicker roller 21. Finally, when the amount of the stored paper-sheets on the plate 10 reaches the amount corresponding to three hundred sheets, as shown in FIG. 13, the light-blocking member pushing unit 43 attached to the holding plate 40 will push the light-blocking member 12 toward the kicker roller 21.

Consequently, the light-blocking member 12 will be moved to a light-passing position, as such the light emitted from the light-emitting part 71 can be reflected by the reflector 15 without being blocked by the light-blocking member 12, thus reaching the light-receiving part 72. In this way, the detection sensor 70 can detect that the number of the stored paper-sheets on the plate 10 has reached the criterion (or amount corresponding to three hundred sheets of paper-sheets).

In the case in which the operator wants to change the criterion, more specifically, in the case in which the operator wants to change the criterion into the amount corresponding to two hundred sheets of paper-sheets, the operator should only shift the position in the width direction of the light-blocking member supporting unit 11 relative to the plate 10, such that the light-blocking member pushing unit 42 corresponding to the setting, i.e., the criterion=200, can push the light-blocking member 12.

It should be appreciated that rather than using the construction as described above, for example, the light-blocking member supporting unit 11 may be fixed in position while the light-blocking member pushing units 41, 42, 43 may be respectively movable in the width direction (or in the upward and downward directions in FIG. 11) relative to the holding plate 40. In this case, the resetting of a desired criterion can be performed by properly shifting each light-blocking member pushing unit 41, 42, 43 in the width direction.

As described above, according to the paper-sheet storing and feeding device of this modification, upon feeding out the paper-sheets, the sensor 70 can detect a change in the state of the light traveling from the light-emitting part 71 to the light receiving part 72 when the light-blocking member 12 is turned from the light-blocking position to the light-passing position due to the operation of each light-blocking member pushing unit 41 (42, 43) attached to the holding plate 40, thereby detecting the timing on which the amount of the paper-sheets on the plate 10 reaches the criterion. This achieves a system for detecting when the amount of the stored paper-sheets is reduced to the criterion during the feeding out of the paper-sheets, with a simple construction while reducing the production cost of the paper-sheet storing and feeding device.

Additionally, because the plurality of light-blocking member pushing units 41, 42, 43 are attached to the holding plate 40, corresponding to the respectively different criteria, the relative positional relationship between the holding plate 40 and the light-blocking member 12 can be optionally changed, by selecting either one of the light-blocking member pushing units 41 (42, 43) in order to turn the light-blocking member 12 as desired. Therefore, the operator can readily set the criterion corresponding to the amount of paper-sheets to be left in the paper-sheet storing and feeding device, as well as change the set criterion with ease.

In this modification, the light-blocking member 12 is in the light-blocking position when no force is externally applied to the light-blocking member 12, while the light-blocking member 12 is moved to the light-passing position when it is pushed by the light-blocking member pushing unit 41 (42, 43) at the time when the amount of paper-sheets reaches the criterion. However, the system for blocking and passing the light is not limited to this aspect. For instance, with alteration of the attachment position of the detection sensor 70, the light-blocking member 12 may be in the light-passing position when no force is externally applied to the light-blocking member 12, and may be pushed by the light-blocking member pushing unit 41 (42, 43) and hence moved to the light-blocking position when the amount of paper-sheets reaches the criterion.

The invention claimed is:

1. A paper-sheet storing and feeding device adapted to temporarily stack paper-sheets fed from the exterior and then bring them into a stored state as well as adapted to feed out the paper-sheets in the stored state to the exterior, the paper-sheet storing and feeding device comprising:

a receptacle adapted for placing the paper-sheets thereon in a standing state;

a stacking and feeding mechanism adapted to successively carry the paper-sheets fed from the exterior, into the receptacle, upon temporarily stacking the paper-sheets, as well as configured to be in contact with a forefront paper-sheet in the receptacle and then feed out the forefront paper-sheet, upon feeding out the paper-sheets in the stored state:

a pushing member provided on the side of the forefront paper-sheet in the receptacle, and configured to be optionally advanced and retracted relative to the forefront paper-sheet, such that when advanced, the pushing member can press the forefront paper-sheet backward so as to disconnect the paper-sheet from the stacking and feeding mechanism, while when retracted, the pushing member can be moved away from the forefront paper-sheet so as to bring the paper-sheet into contact with the stacking and feeding mechanism;

a holding member provided to be in contact with a backmost paper-sheet in the receptacle, and configured to be optionally advanced and retracted relative to the stacking and feeding mechanism;

a storage space defined between the stacking and feeding mechanism and the holding member in the receptacle, and adapted for storing the paper-sheets therein;

a retaining member provided to be optionally advanced and retracted relative to the storage space, such that when advanced, the retaining member can be in contact with the forefront paper-sheet among the paper-sheets moved to be spaced away from the stacking and feeding mechanism due to the pushing member in the receptacle so as to hold the paper-sheets between the retaining member and the holding member and bring them into a temporary holding state, while when retracted, the retaining member can release the paper-sheets; and a drive mechanism configured to operate the pushing member, the holding member and the retaining member, such that the holding member can be retracted to be moved away from the stacking and feeding mechanism while the pushing member can be advanced, and the retaining member can be advanced into the storage space so as to bring the paper-sheets having been moved to be spaced away from the stacking and feeding mechanism due to the pushing member in the receptacle, into the temporary holding state, thereby defining a temporary stacking space, and such that upon bringing the paper-sheets newly stacked in the temporary stacking space due to the stacking and feeding mechanism, into the stored state, the holding member can be advanced toward the stacking and feeding mechanism while the retaining member can be retracted from the forefront paper-sheet in the temporary holding state in the receptacle.

2. The paper-sheet storing and feeding device according to claim 1, wherein a detection sensor having a light-emitting part and a light-receiving part is provided in the vicinity of the receptacle, wherein the receptacle includes a plate adapted for placing the paper-sheets thereon, and a light-blocking member having a proximal end turned by the plate, such that the light-blocking member can be turned between a light-blocking position in which light emitted from the light-emitting part of the detection sensor is blocked so as not to reach the light-receiving part of the detection sensor and a light-passing position in which the light can travel up to the light-receiving part, wherein the holding member includes a light-blocking member pushing unit configured to be in contact with the light-blocking member when an amount of the paper-sheets in the receptacle reaches a criterion when the holding member is advanced upon feeding out the paper-sheets, thereby turning the light-blocking member, and wherein the detection sensor is configured to detect change in a state of the light traveling from the light-emitting part to the light-receiving part when the light-blocking member is turned by the light-blocking member pushing unit of the holding member, thereby detecting a timing on which the amount of the paper-sheets in the receptacle reaches the criterion upon feeding out the paper-sheets.

3. The paper-sheet storing and feeding device according to claim 2, wherein the holding member includes a plurality of light-blocking member pushing units respectively formed corresponding to different criteria, whereby the relative positional relationship between the holding member and the light-blocking member can be optionally changed so as to select either one of the light-blocking member pushing units for turning the light-blocking member.

* * * * *